US011239601B2

(12) United States Patent
Bishop et al.

(10) Patent No.: US 11,239,601 B2
(45) Date of Patent: Feb. 1, 2022

(54) HOUSING FOR USE IN MOTOR VEHICLES

(71) Applicant: Kiekert AG, Heiligenhaus (DE)

(72) Inventors: Bryan Bishop, Walled Lake, MI (US); John Dey, Wixom, MI (US); Michael Endicott, Novi, MI (US); James A. Svoboda, Byron, MI (US); Dave Taylor, Livonia, MI (US)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 16/702,638

(22) Filed: Dec. 4, 2019

(65) Prior Publication Data

US 2021/0175660 A1 Jun. 10, 2021

(51) Int. Cl.

| | |
|---|---|
| ***H01R 13/52*** | (2006.01) |
| ***E05B 79/20*** | (2014.01) |
| ***E05B 85/02*** | (2014.01) |

(52) U.S. Cl.

CPC ..... *H01R 13/5219* (2013.01); *E05B 79/20* (2013.01); *E05B 85/02* (2013.01); *H01R 2201/26* (2013.01)

(58) Field of Classification Search

CPC ..... E05B 79/20; E05B 81/16; E05B 81/06; E05B 85/02; H01R 13/5205; H01R 13/5219; H01R 13/5221; H01R 2201/26

USPC ..... 439/587, 588, 275

See application file for complete search history.

(56) References Cited

U.S. PATENT DOCUMENTS 4,702,710 A * 10/1987 Dittman ..... H01R 13/5205 439/125
5,017,160 A * 5/1991 Garcia ..... E21B 17/028 439/271
7,670,164 B2 * 3/2010 Shiga ..... H01R 13/5221 439/278
8,974,242 B2 * 3/2015 Lee ..... H01R 13/562 439/278
2004/0192093 A1 * 9/2004 Borgstrom ..... H01R 43/26 439/187
2005/0176295 A1 * 8/2005 Morita ..... H01R 13/5219 439/587
2006/0048598 A1 * 3/2006 Roussel ..... F16C 1/16 74/502.6
2011/0150394 A1 * 6/2011 Sorensen ..... H01R 13/523 385/53

(Continued)

FOREIGN PATENT DOCUMENTS

CN 208280776 U 12/2018
DE 102018105550 A1 9/2019

(Continued)

OTHER PUBLICATIONS

Written Opinion issued Mar. 5, 2021, for related International Patent Application No. PCT/IB2020/061016.

*Primary Examiner* — Marcus E Harcum
(74) *Attorney, Agent, or Firm* — Renner, Otto, Boisselle & Sklar, LLP

(57) ABSTRACT

A housing for use in motor vehicles, in particular a motor vehicle latch housing. The basic structure of said housing comprises a connecting region and a seal that surrounds the connecting region, and a connecting element that is connected to the housing interior by means of the connecting region. According to the invention, the seal is formed as a sealing grommet that engages over the connecting region and can connect to the housing.

13 Claims, 2 Drawing Sheets

(56) References Cited

U.S. PATENT DOCUMENTS

Figure 1:
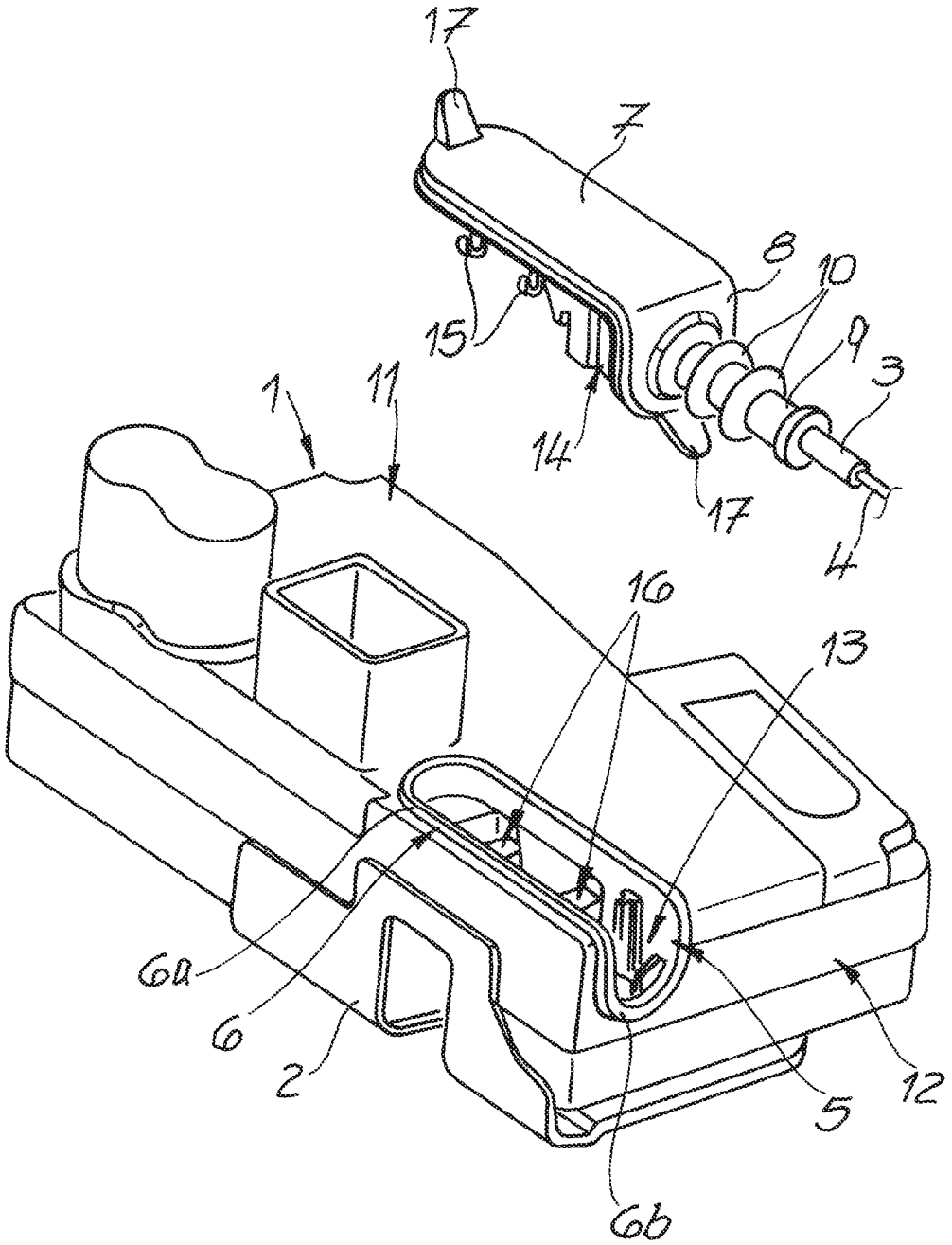

| | | | | |
|---|---|---|---|---|
| 2014/0370753 | A1* | 12/2014 | Kobayashi | H01R 13/5216 439/607.41 |
| 2019/0017298 | A1 | 1/2019 | Sardelli et al. | |
| 2019/0148873 | A1* | 5/2019 | Poterjoy | H01R 13/533 439/587 |
| 2019/0288453 | A1* | 9/2019 | Blake | G06F 1/18 |
| 2019/0296494 | A1* | 9/2019 | Kitagawa | H01R 13/621 |
| 2019/0312385 | A1* | 10/2019 | Shain | H04N 5/232 |
| 2019/0345744 | A1 | 11/2019 | Woo et al. | |
| 2020/0099160 | A1* | 3/2020 | Masuda | H01R 13/516 |
| 2020/0274292 | A1* | 8/2020 | Goodfellow | H01R 13/5219 |

FOREIGN PATENT DOCUMENTS

| | | | |
|---|---|---|---|
| EP | 0453341 | B1 | 10/1991 |
| WO | 2019016970 | A1 | 1/2019 |
| WO | 2019138290 | A1 | 7/2019 |

* cited by examiner

HOUSING FOR USE IN MOTOR VEHICLES

The invention relates to a housing for use in motor vehicles, in particular a motor vehicle latch housing, comprising a connecting region and a seal that surrounds and seals the connecting region, and comprising a connecting element that is connected to the housing interior by means of the connecting region.

Housings for use in motor vehicles have to meet various requirements. On the one hand, these include the required degree of temperature stability, which is in the range of from approximately −50° C. up to approximately +80° C., and, on the other hand, the necessary degree of tightness to dust and moisture. For this reason, the connecting element connected to the housing needs to be sealingly coupled to the housing or the housing interior by means of the seal. The connecting element can, in principle, be a mechanical connecting element as well as an electrical connecting element.

A mechanical connecting element is provided when the motor vehicle latch housing is coupled by means thereof to an inner handle or an outer handle, for example. In this case, the mechanical connecting element is formed as a Bowden cable, for example. However, it is also possible for the connecting element to be formed as an electrical connecting element. An electrical connection to the motor vehicle latch housing is then established by means of the connecting element. This is the case when the motor vehicle latch used at this point is an electric latch, for example.

In this case, an associated inner handle or outer handle is not mechanically connected to the motor vehicle latch in question, but instead a signal from a sensor provided in the region of the inner handle or outer handle is retrieved. The signal associated with operating the particular handle is then in turn transmitted into the motor vehicle latch housing where it ensures that an electric motor arranged inside said housing draws out an associated locking mechanism by means of an electric motor. Of course, hybrid forms of the connecting element mentioned are also possible in that said element is or can be both a mechanical connecting element and an electrical connecting element.

In all of these cases, however, it is frequently necessary for the connecting element in question to be sealingly connected to the interior of the motor vehicle latch housing in order to keep the above-mentioned dust or any moisture that may occur, in particular, away from the interior of the motor vehicle latch housing so as to also be able to ensure the functional reliability of the units arranged in the interior over a long period of time. Similar requirements and designs are, of course, also relevant and significant in the event that said housing for use in motor vehicles is not necessarily a motor vehicle latch housing, but alternatively a housing for a power window motor, a housing for a lock for a tailgate, a housing for a door drive, etc., for example. Something that all of these applications have in common is that, on the one hand, the particular mechanical and/or electrical connecting element can be sealingly connected to the interior of the housing and, on the other hand, the seal can be simply, quickly and cost-effectively coupled to the housing.

The generic prior art according to EP 0453 341 B1 already describes a housing for use in motor vehicles, in which a conductor bundle is coupled to a connecting apparatus. In addition, a seal is formed that is placed around the connecting apparatus.

Similar prior art is known from WO 2019/138290 A1, which is traced back to the applicant. In this document, a mechanical connecting element is coupled to an associated housing in order to produce a connection between a handle for internal operation and/or external operation. The seal mentioned in this connection is in the form of a sealing ring and lastly attached to a flexible operating element. This requires special measures during mounting and is relatively complex.

The prior art illustrated has proven itself in principle with regard to sealing the connecting element guided inside the housing. However, specific preparatory work is generally required at this point in order to provide the connecting element with the particular seal so as to be able to subsequently couple the connecting element to the housing by placing the seal therebetween. The invention intends to remedy all of this.

The technical problem of the invention is to develop such a housing for use in motor vehicles such that mounting and assembly are considerably simpler in comparison with previous procedures.

In order to solve this technical problem, a generic housing is characterized within the context of the invention in that the seal is formed as a sealing grommet that engages over the connecting region and can be connected to the housing.

The seal used is first and foremost a sealing grommet, that is a tubular seal through which the mechanical and/or electrical connecting element can be guided and simultaneously fastened. In this case, the connecting region on the housing on the whole ensures that the sealing grommet is fixed. For this purpose, a sealing flange that surrounds the connecting region is usually provided for connecting the sealing grommet.

The connecting region generally comprises an opening or itself forms an opening in the housing, through which the mechanical and/or electrical connecting element protrudes until it is inside the housing. In this way, the mechanical connecting element in the form of a Bowden cable can, for example, also establish the mechanical connection required to a lever system or a drive motor provided inside the housing, for example. The opening in the connecting region is advantageously surrounded by the sealing flange. The sealing flange is in turn used for connecting the sealing grommet.

For this purpose, the sealing flange can comprise a circumferential collar, over which a mating collar on the sealing grommet engages during mounting. In this case, the housing together with the collar integrally molded thereon as a whole is usually made of plastics material. Thermoplastics have proven themselves to be especially advantageous here.

In contrast, the sealing grommet together with the mating collar formed thereon is made of an elastomer, i.e. an elastomeric plastics material. In this way, the mating collar can elastically and resiliently engage over the collar of the housing, which collar is fixed in position by comparison, when the sealing grommet is mounted on the connecting region. This can be done quickly and without problems and directly provides the degree of tightness required in this region.

According to an advantageous embodiment, the sealing flange and the sealing grommet generally comprise a three-dimensional extension. In this case, the sealing grommet usually comprises a cover region and a connecting region that protrudes therefrom at an angle. The connecting region is in turn typically provided with a tube extension. The mechanical and/or electrical connecting element is passed through the tube extension and into the housing. In order to allow for an especially resilient connection at this point, the tube extension advantageously comprises concertina-like bulges for sealing the flexible connecting element that passes through said tube extension over a variable length.

By means of the concertina-like bulges in the tube extension, the core of a Bowden cable can, for example, be sealingly surrounded, specifically also if the Bowden cable core and together therewith the tube extension, are moved back and forth in the longitudinal direction. Nevertheless, in the example the Bowden cable is coupled to the interior of the housing in a dust-tight and water-tight manner.

Similarly to the three-dimensional extension of the sealing grommet, the sealing flange in turn comprises a cover flange and a connecting flange that is connected thereto at an angle. In this case, the cover region of the sealing grommet corresponds to the cover flange of the sealing flange. In contrast, the connecting region of the sealing grommet interacts with the connecting flange of the sealing flange.

According to an advantageous embodiment, the connecting flange also comprises a plug receptacle on the sealing grommet for a plug plate. In addition, the invention is usually designed such that the cover region of the sealing grommet engages over the cover flange and the connecting region of the sealing grommet engages over the connecting flange of the sealing flange. By means of the additional plug connection that is advantageously provided in this connection between the plug receptacle of the connecting flange and the plug plate on the sealing grommet, the sealing grommet according to the invention can not only be properly coupled to the sealing flange on the housing, but is also able to act as an abutment. This is provided in particular by the plug receptacle and plug plate, which interact with one another.

In addition, the plug connection between the sealing grommet and the sealing flange makes it possible for the plug connection produced to not only provide the required degree of tightness between the sealing grommet and the housing, but to also couple the connecting element, which is sealingly guided inside the sealing grommet, to a mating connecting element inside the housing in one step. For example, this mating connecting element inside the housing can be an electrical socket if the electrical connecting element that passes through the sealing grommet is provided with an associated plug.

However, if the connecting element is a mechanical connecting element, for example a Bowden cable, said connecting element can be one or more connecting nipples, which are mechanically coupled to a nipple receptacle, in the form of a mating connecting element, inside the housing when connecting the sealing grommet and the sealing flange. The interplay simultaneously achieved at this point between the plug receptacle and the plug plate here likewise ensures that possible restoring forces that occur when the core of the Bowden cable moves on the sheath that surrounds the core are transmitted to the housing by means of the sealing grommet.

Lastly, the sealing grommet is advantageously usually additionally provided with at least one handling lug. Two handling lugs are usually formed, specifically one handling lug on the cover region and another second handling lug on the connecting region of the sealing grommet. Furthermore, the invention is then usually designed such that the cover region of the sealing grommet and the associated connecting region that protrudes at an angle are predominantly oriented at a right angle to one another. This means that the cover region and the connecting region describe a backwards L when viewed from the side. Furthermore, the invention is usually designed such that the cover region extends in a predominantly coplanar manner with respect to a housing upper side or a housing lower side, whereas the connecting region, as a component of the sealing grommet, is predominantly oriented in the direction of a housing lateral face. As a result, the sealing grommet can be practically attached to the housing when viewed from the housing upper side or the housing lower side, the connecting region of the sealing grommet likewise ending with the adjacent housing lateral face.

This leads to simple, quick and targeted mounting. Likewise, when mounting the sealing grommet according to the invention, the connecting element forms a plug connection with the associated mating connecting element inside the housing, for example by means of its electrical plug or its connecting nipple. In the former case, the mating connecting element is an electrical socket and, in the case of a mechanical connection, a nipple receptacle for the connecting nipple.

Either way, the connecting element including the sealing grommet according to the invention can be coupled to the housing, which is for use in motor vehicles, in the connecting region both simply and without problems. In this case, a tight connection is likewise established, which also ensures the corresponding electrical or mechanical connection to the associated connecting element. All of this can be achieved simply, intuitively and without problems while keeping low production costs in mind. This is where the essential advantages can be found.

Figure 2:
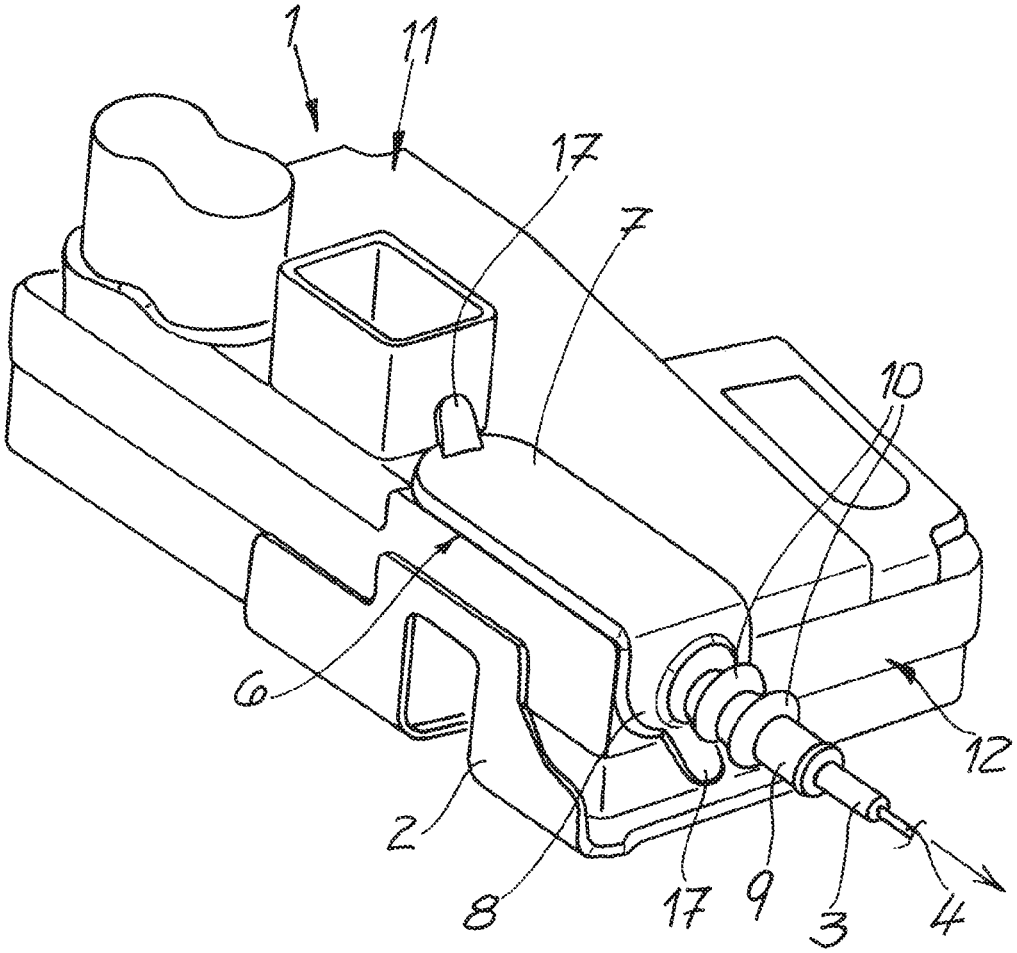

The invention will be explained in more detail in the following on the basis of a set of drawings, which show just one exemplary embodiment, in which:

FIG. 1 shows the motor vehicle housing according to the invention, which is for use in motor vehicles, during assembly, and FIG. 2 shows the subject matter according to FIG. 1 in the finished, assembled state.

The figures show a housing for use in motor vehicles. The housing is a motor vehicle latch housing 1, but is not restricted thereto. The motor vehicle latch housing 1 covers a latch case 2, which is also shown in the figures. The latch case 2 is used to store a locking mechanism (not shown in more detail). The locking mechanism is composed of a catch and a pawl. Furthermore, a plurality of levers are additionally formed as components of a lever system, all of which are accommodated inside the motor vehicle latch housing 1 and are not shown in detail.

In order to operate the lever inside the motor vehicle latch housing 1 according to the exemplary embodiment, internal operation and external operation are provided. The internal or external operation uses a connecting element 3, 4 for this purpose, which is formed as, but not restricted to, a Bowden cable 3, 4 having a sheath 3 and a core 4 that can move back and forth inside the sheath 3 for this purpose.

The lever system accommodated inside the motor vehicle latch housing 1 is mechanically coupled to a handle (not shown in more detail) by means of the mechanical connecting element 3, 4 in order to operate the locking mechanism. The handle can be an external handle, for example an external door handle. However, it is also equally possible for the handle to be formed as an internal handle, for example an internal door handle. In any case, the lever inside the motor vehicle latch housing 1 and therefore the locking mechanism can be operated from the inside and/or the outside by means of the handle in question. In this way, the locking mechanism is intended to be opened. For this, in the exemplary embodiment according to FIG. 1, the core 4 of the Bowden cable 3, 4 can be acted upon by being pulled, as is shown by an arrow in FIG. 2. Said figure does not show the fact that it is possible for the connecting element 3, 4 to alternatively not be a mechanical connecting element, but an electrical connecting element. In this case, the connecting element 3, 4 is one or more electrical lines that are guided inside the motor vehicle latch housing 1.

In all of these cases, the housing or motor vehicle latch housing 1 shown is on the whole provided with a connection region 5 in the example, which manifests itself in the exemplary embodiment as an opening 5 in the housing or motor vehicle latch housing 1. In addition, a sealing flange 6 that surrounds the connecting region 5 is formed. On the whole, the sealing flange 6 is used to mount and connect a seal 7, 8, 9, 10. According to the invention, the seal 7, 8, 9, 10 is formed as a sealing grommet 7, 8, 9, 10, which engages over the connecting region 5 and can connect to the housing or motor vehicle latch housing 1. In addition, the seal 7, 8, 9, 10 ensures that the connecting region 5 is sealed. In fact, the sealing grommet 7, 8, 9, 10 comprises a tubular tube extension 9, 10, through which the connecting element 3, 4 is guided in the example, and in which it is sealingly accommodated. In addition, the tube extension 9, 10 ensures that the connecting element 3, 4 is fastened to the seal 7, 8, 9, 10 in question.

For this purpose, the tube extension 9, 10 comprises concertina-like bulges 10, which, according to the exemplary embodiment, are used to seal the flexible connecting element 3, 4 that passes through said tube extension over a variable length. In fact, the tube extension 9, 10 sealingly surrounds the sheath 3 of the Bowden cable 3, 4. In principle, the sheath 3 could, however, also be omitted at this point such that, in the example, the tube extension 9, 10 can follow any longitudinal movements of the core 4 of the Bowden cable 3, 4 as a result of its concertina-like bulges 10 in this case, which core passes through the tube extension 9, 10.

In the exemplary embodiment, the sealing grommet 7, 8, 9, 10 according to the invention interacts with the sealing flange 6 in order to connect the sealing grommet 7, 8, 9, 10 by the sealing flange 6, which surrounds the connecting region 5 or the opening in the motor vehicle latch housing 1, comprising a collar on its head, which is likewise circumferential and surrounds the connecting region 5. This collar of the sealing flange 6 interacts with a collar of the sealing grommet 7, 8, 9, 10, which is not shown in more detail. Since the sealing grommet 7, 8, 9, 10 according to the exemplary embodiment is made of a resilient plastics material, for example an elastomer, whereas the motor vehicle latch housing 1 together with the sealing flange 6 constitutes a shaped plastics part, in particular a molded plastics part, made of a thermoplastic, the sealing grommet 7, 8, 9, 10 can be easily coupled to the sealing flange 6 by elastically deforming in the course of the mounting process when transitioning from FIG. 1 to FIG. 2.

One special feature is that the sealing flange 6 and the sealing grommet 7, 8, 9, 10 collectively comprise a three-dimensional extension. For this purpose, the sealing grommet 7, 8, 9, 10 first and foremost comprises a cover region 7, which extends approximately in parallel with or in a coplanar manner with respect to an upper side 11 of the housing 1 in the assembled state according to FIG. 2. In addition to the cover region 7, a connecting region 8, which is connected to the cover region 7 at an angle and protrudes therefrom at an angle, is formed as a component of the sealing grommet 7, 8, 9, 10 in addition to the tube extension 9, 10 already discussed above. In the mounted state, the connecting region 8 of the sealing grommet 7, 8, 9, 10 extends predominantly in parallel with or in a coplanar manner with respect to a housing lateral face 12 of the motor vehicle latch housing 1 in the example. In this case, the cover region 7 interacts with a cover flange 6 as a component of the sealing flange 6, whereas the connecting region 8 that is arranged at an angle to the cover region 7 interacts with the connecting flange 6, which connects to the cover flange 6 at an angle, as an additional component of the sealing flange 6. All in all, the cover region 7 of the sealing grommet 7, 8, 9, 10 engages over the cover flange 6 and the connecting region 8 engages over the connecting flange **6*b***.

In addition, an essential plug receptacle 13 can be seen in the region of the connecting flange **6*b* as a component of the sealing flange 6. In this case, the plug receptacle 13 is implemented and formed inside the motor vehicle latch housing 1. In this case, the invention is on the whole designed such that the plug receptacle 13 interacts with a plug plate 14 on the sealing grommet 7, 8, 9, 10. In fact, when the sealing grommet 7, 8, 9, 10 is attached to the motor vehicle latch housing 1 in the example, the connecting element 3, 4 or the connecting region 5 is sealed and a plug connection 13, 14 is simultaneously produced by the plug plate 14 engaging in the plug receptacle 13. This plug connection 13, 14 acts as an abutment for the mechanical connecting element 3, 4**.

Furthermore and last of all, the plug connection 13, 14 between the sealing grommet 7, 8, 9, 10 and the connecting region 5 of the motor vehicle latch housing 1 mechanically couples the mechanical connecting element 3, 4 to the lever system inside the motor vehicle latch housing 1 by means of one or more end-face connecting nipples 15 in the example. For this, the connecting nipples 15 on the end face of the mechanical connecting element 3, 4 are coupled to one or more mating connecting elements inside the motor vehicle latch housing 1, which, in the case of the connecting nipples 15, are corresponding mating connecting elements or nipple receptacles 16 that are only shown in FIG. 1.

Lastly, it can additionally be seen that the sealing grommet 7, 8, 9, 10 comprises at least one handling lug 17. According to the exemplary embodiment, two handling lugs 17 are provided and formed, specifically one handling lug 17 on the cover region 7 of the sealing grommet 7, 8, 9, 10 and the other handling lug 17 on the connecting region 8 that protrudes therefrom at an angle. In the example, the sealing grommet 7, 8, 9, 10 can be removed from the housing or the motor vehicle latch housing 1 by means of the handling lug 17, if necessary.

LIST OF REFERENCE NUMERALS

1 motor vehicle latch housing
2 latch case
3, 4 connecting element or Bowden cable
3 sheath
4 core
5 connecting region or opening
6 sealing flange
**6*a*** cover flange
**6*b*** connecting flange
7, 8, 9, 10 seal or sealing grommet
7 cover region
8 connecting region
9, 10 tubular tube extension
10 concertina-like bulges
11 upper side
12 housing lateral face
13 plug receptacle
14 plug plate
15 connecting nipple
16 nipple receptacles
17 handling lug

The invention claimed is:

1. A housing for a motor vehicle, the housing comprising:

a connecting region formed as an opening in the housing;

a seal that seals the connecting region; and a flexible connecting element that is connected to an interior of the housing by the connecting region, wherein the seal is formed as a sealing grommet that engages over the connecting region and is removably connected to the housing, and wherein the flexible connecting element passes through a wall of the sealing grommet and into the opening of the housing when the sealing grommet is connected to the housing;

wherein a sealing flange that surrounds the connecting region is provided for connecting the sealing grommet; and wherein the opening is formed to open along a first side of the housing and a second side of the housing, wherein the sealing flange extends along both the first side and the second side.

2. The housing according to claim 1, wherein the sealing flange and the sealing grommet comprise a three-dimensional extension.

3. The housing according to claim 1, wherein the sealing grommet comprises a cover region and a connecting region that protrudes therefrom at an angle.

4. The housing according to claim 3, wherein the connecting region comprises a tube extension.

5. The housing according to claim 4, wherein the tube extension comprises concertina-like bulges for sealing the flexible connecting element that passes through said tube extension over a variable length.

6. The housing according to claim 1, wherein the sealing flange comprises a cover flange and a connecting flange that is connected thereto at an angle.

7. The housing according to claim 6, wherein the connecting flange comprises a plug receptacle on the sealing grommet for a plug plate.

8. The housing according to claim 3, wherein the cover region of the sealing grommet engages over a cover flange and the connecting region engages over a connecting flange.

9. The housing according to claim 1, wherein the sealing grommet comprises at least one handling lug.

10. The housing according to claim 1, wherein the first side and the second side extend perpendicular to each other.

11. The housing according to claim 3, wherein the cover region is arranged coplanar to an upper side of the housing and the connecting region is arranged coplanar to a lateral face of the housing.

12. The housing according to claim 11, wherein the flexible connecting element extends from the lateral face of the housing.

13. The housing according to claim 1, wherein the opening extends inwardly into the housing from an outer planar surface of the housing.

* * * * *